US006450577B1

(12) United States Patent
Roslund, Jr.

(10) Patent No.: US 6,450,577 B1
(45) Date of Patent: Sep. 17, 2002

(54) MULTIFUNCTION TILT CONTROL WITH SINGLE ACTUATOR

(75) Inventor: Richard N. Roslund, Jr., Jenison, MI (US)

(73) Assignee: Haworth, Inc., Holland, MI (US)

( * ) Notice: Subject to any disclaimer, the term of this patent is extended or adjusted under 35 U.S.C. 154(b) by 10 days.

(21) Appl. No.: 09/730,001

(22) Filed: Dec. 4, 2000

(51) Int. Cl.[7] ..... A47C 1/032

(52) U.S. Cl. ..... 297/301.7; 297/300.8; 297/300.4

(58) Field of Search ..... 297/300.3, 300.4, 297/300.7, 300.8, 301.3, 301.6, 301.7, 302.3, 302.6, 302.7, 463.1

(56) References Cited

U.S. PATENT DOCUMENTS

| | | | | |
|---|---|---|---|---|
| 4,364,605 A | * | 12/1982 | Meiller | 297/300.8 |
| 4,603,905 A | * | 8/1986 | Stucki | 297/300.3 |
| 4,664,445 A | | 5/1987 | Groseth | |
| 4,743,065 A | | 5/1988 | Meiller et al. | 297/300.8 |
| 4,818,020 A | | 4/1989 | Meiller et al. | 297/300.3 |
| 4,838,510 A | | 6/1989 | Holstensson | |
| 5,464,274 A | | 11/1995 | Golynsky et al. | |
| 5,577,807 A | | 11/1996 | Hodge et al. | |
| 5,658,045 A | | 8/1997 | Van Koolwijk et al. | |
| 5,765,914 A | | 6/1998 | Britain et al. | |
| 5,915,788 A | | 6/1999 | Schneider | |
| 6,276,755 B1 | * | 8/2001 | Su | 297/300.4 |

* cited by examiner

*Primary Examiner*—Peter R. Brown
(74) *Attorney, Agent, or Firm*—Flynn, Thiel, Boutell & Tanis, P.C.

(57) ABSTRACT

A tilt control is provided in an office chair to operatively connect tiltable seat and back assemblies. The tilt control permits both forward and rearward tilting of the seat and back assemblies and includes a tilt lock mechanism and a single actuator for selectively locking out forward and/or rearward tilting. In particular, the actuator has a handle which moves along a single path passing through first to third operative positions. In this regard: the first operative position locks out both forward and rearward tilting in any of a plurality of tilt positions; the second operative position locks out forward tilting but permits rearward tilting; and the third operative position permits both forward and rearward tilting.

8 Claims, 15 Drawing Sheets

MULTIFUNCTION TILT CONTROL WITH SINGLE ACTUATOR

FIELD OF THE INVENTION

The invention relates to a tilt control mechanism for an office chair, and more particularly, to a tilt control having multiple tilting functions controlled by a single actuator.

BACKGROUND OF THE INVENTION

Office chairs often include tilt controls which connect a seat assembly to a base and a back assembly to the seat assembly wherein relative tilting of the seat and back assemblies is controlled by the tilt control. Depending upon the tilt control mechanism, the tilt control may permit different combinations of forward and rearward tilting of the back assembly and/or the seat assembly. Often, known tilt controls may include separate control handles which are manually actuatable by a chair occupant to control forward and/or rearward tilting.

In such known tilt controls, the tilt control may include a tilt control handle which is actuatable to lockout rearward tilting wherein the back assembly may be locked in a normal upright position or a rearwardly tilted position disposed rearwardly of the normal upright position. Additionally, if a particular tilt control permits forward tilting, a second actuator handle may be provided to lockout forward tilting with the seat assembly being locked in the normal upright position or a forwardly tilted position. This is a general example of a tilt control, and other variations of tilt controls have also been provided which permit the user to control a variety of features of the tilt control.

For example, the tilt control disclosed in U.S. Pat. No. 4,664,445 includes a control handle which controls a lock mechanism that is lockable in multiple positions. More particularly, the lock mechanism of the tilt control enables locking of the seat in a forward tilted, neutral, or a backward tilted position.

U.S. Pat. No. 4,838,510 discloses another tilt control wherein an operating member is rotated in opposite directions to respectively lockout forward or rearward tilting and is raised vertically to permit simultaneous movement of the back-rest and seat thereof.

Other tilt controls are disclosed in U.S. Pat. Nos. 4,743,065, 4,818,020, 5,464,274 and 5,577,807.

It is an object of the invention to provide an improved tilt control for an office chair having a single actuator which controls multiple functions of the tilt control.

The invention relates to an office chair having seat and back assemblies operatively connected together by a tilt control. The tilt control permits forward and rearward tilting of the seat and back assemblies and includes a single actuator for controlling the forward and rearward tilting.

More particularly, the actuator handle is accessible by an occupant and is movable through three operative positions along an elongate actuator path. The actuator preferably is rotatable sequentially through the three operative positions. In the first operative position, both forward and rearward tilting is locked out, i.e. prevented, for example, when the back assembly is in a normal upright or nominal position. The actuator also is movable sequentially to a second operative position, and then to a third operative position. In the second operative position, normal chair operation is permitted wherein rearward tilting from the upright position is permitted but forward tilting is locked out. In the third operative position, both forward and rearward tilting is permitted.

This arrangement is easier to use than multiple handle chairs in that only one motion of a single actuator is required by the occupant, namely rotation of the actuator handle clockwise or counterclockwise through the three operative positions.

Other objects and purposes of the invention, and variations thereof, will be apparent upon reading the following specification and inspecting the accompanying drawings.

Figure 1:
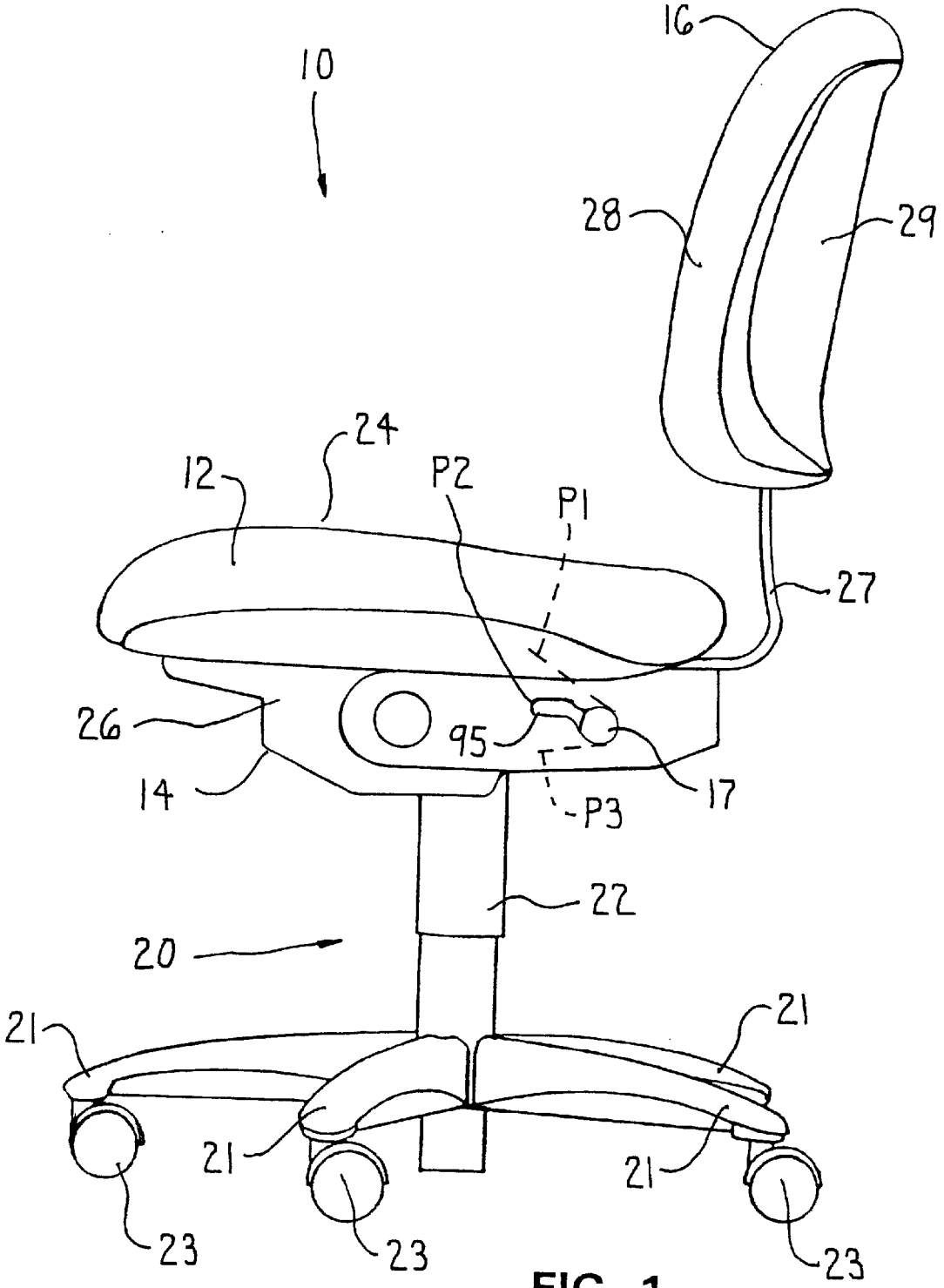
FIG. 1 is a left side elevational view of an office chair of the invention illustrating seat and back assemblies connected together by a tilt control.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to FIG. 1, a chair 10 is illustrated having a seat assembly 12 supported on a tilt control 14 and a back assembly 16 pivotally connected to the tilt control 14. Generally, the tilt control 14 includes a single actuator handle 17 which is movable through three operative positions to control forward and rearward tilting of the seat and back assemblies 12 and 16 as will be described herein.

Generally, the office chair 10 includes a base 20 having legs 21 radiating outwardly from a lower end of a vertical pedestal 22. The outer ends of the legs 21 include conventional casters 23 which support the office chair 10 on a floor or other similar surface.

The upper end of the pedestal 22 rigidly supports the seat assembly 12 thereon. In particular, the seat assembly 12 includes a horizontally enlarged seat 24 which seat 24 overlies and is supported on the pedestal 22 by the tilt control 14.

Referring to FIGS. 1–4, the tilt control 14 generally includes a control body or housing 26 which is rigidly connected to the pedestal 22, and an L-shaped upright 27 which is pivotally connected to the control body 26. The upper end of the upright 27 supports the back assembly 16 thereon, which back assembly 16 includes a vertically-enlarged back cushion unit 28 that supports the body of the chair occupant. A back cover 29 is provided on the rear face of the back cushion unit 28.

Figure 2:
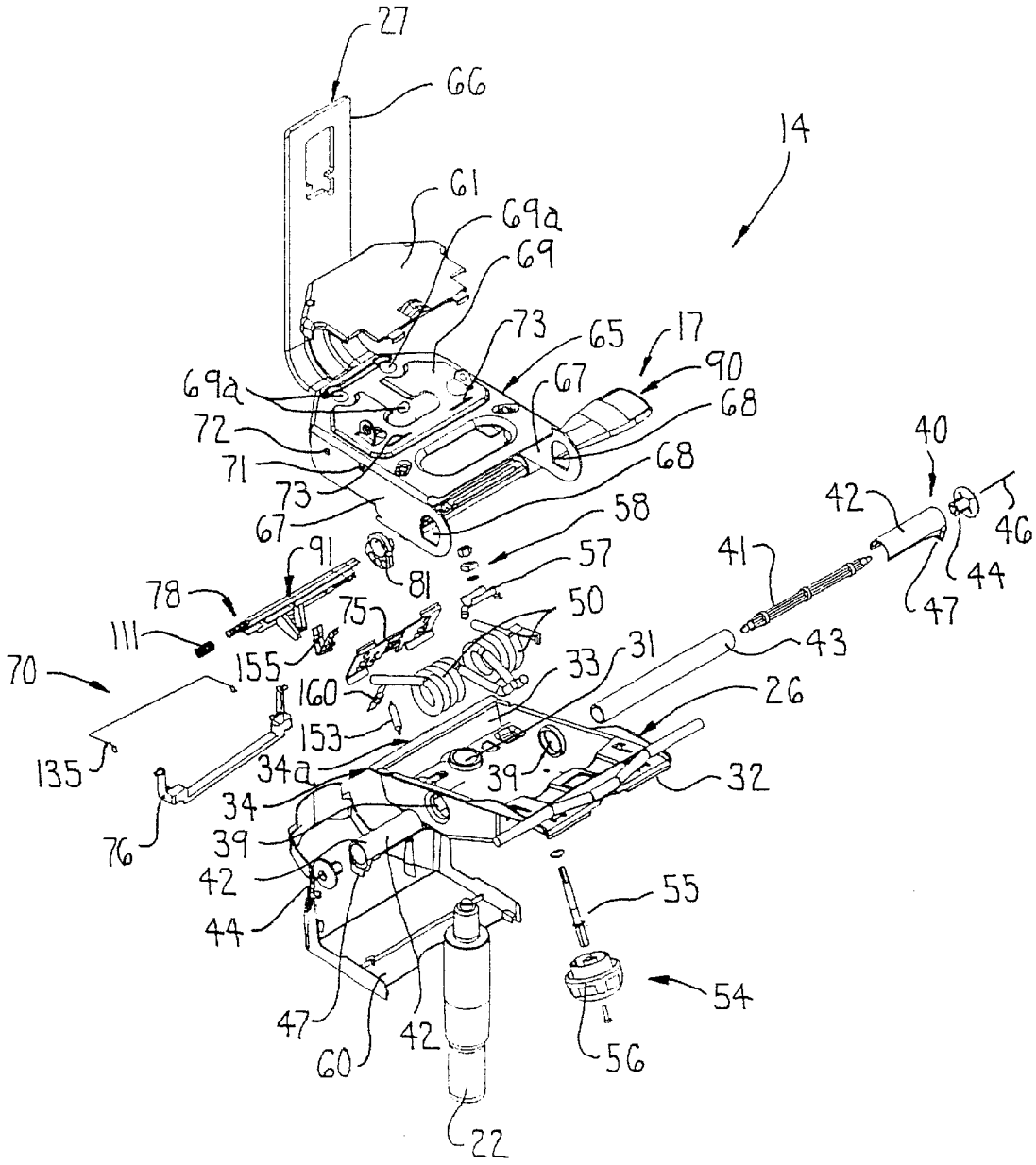
FIG. 2 is an exploded view of the tilt control.

More particularly, the control body 26 has an upward opening pan shape which includes a pedestal mount 31 that rigidly mounts the control body 26 to the upper end of the pedestal 22. The pedestal mount 31 is a vertical opening defined by an upstanding flange as seen in FIG. 2. The pedestal 22 is fixed to pedestal mount 31 whereby the control body 26 is spaced vertically above the floor and remains stationary during tilting of the seat and back assemblies 12 and 16.

A front edge section 32 of the control body 26 is adapted to pivotally connect the seat assembly 12 to the tilt control 14. As a result, rearward tilting of the back assembly 16 causes a corresponding downward tilting of the seat assembly 12 about the front edge section 32, while forward tilting of the back assembly 16 causes the rear edge of the seat assembly 12 to lift upwardly.

Figure 3:
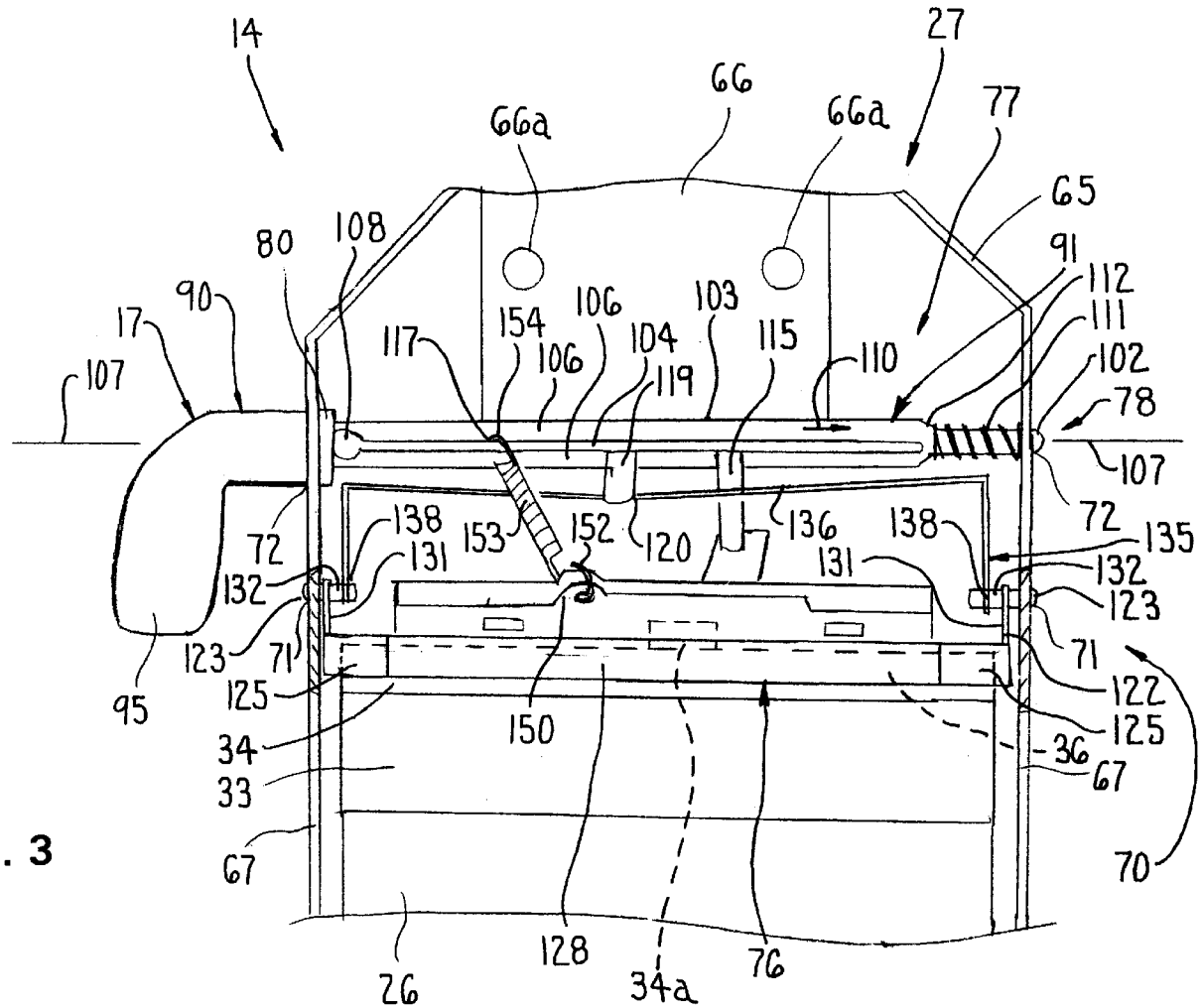
FIG. 3 is bottom view of the tilt control.
Figure 4:
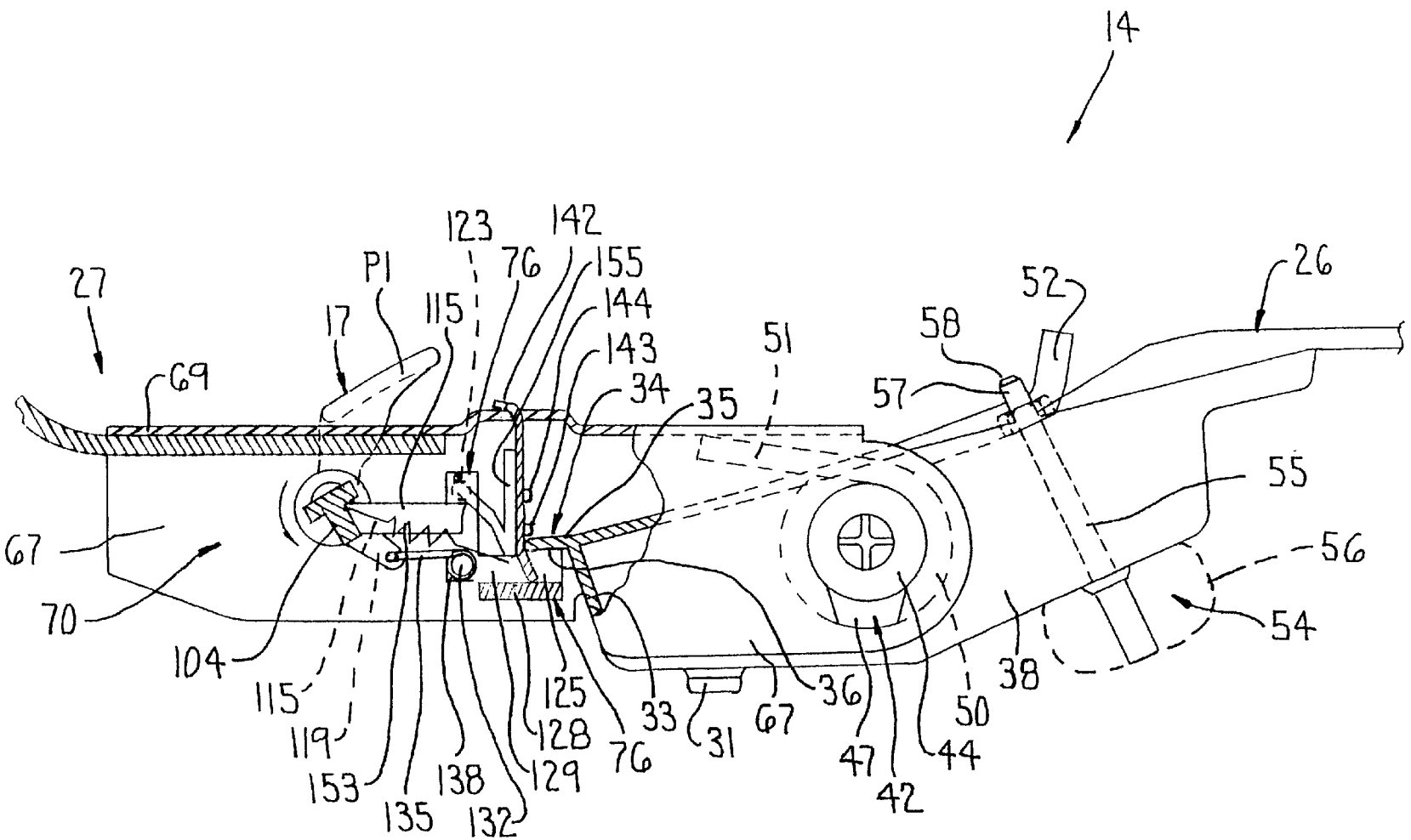
FIG. 4 is a right side elevational view in partial cross section illustrating an actuator of a tilt lock mechanism in a first operative position and an upright in a nominal position.

The control body 26 also has a lip or flange along the rear edge thereof which projects rearwardly from the rear body wall 33 (FIG. 4) to define a stop flange 34 extending sidewardly or laterally along the length of the rear edge. As seen in FIG. 4, the stop flange 34 defines upper and lower stop surfaces 35 and 36 which respectively face upwardly and downwardly, and includes a rigid rectangular tab 84a which projects rearwardly (FIG. 3) and downwardly at an angle (FIG. 6) from the edge of the stop flange 34.

To pivotally support the upright 27 on the control body 26, the opposite side walls 38 of the control body 26 include aligned shaft openings 39, and the tilt control 14 also includes a shaft assembly 40 which pivotally connects the upright 27 to the shaft openings 39. The shaft assembly 40 includes: a central shaft 41 which extends sidewardly between the shaft openings 39; a pair of tubular bearing sleeves 42 which fit into the respective openings 39; a cylindrical spring support sleeve 43 which slides concentrically over the shaft 41 and is disposed centrally between the bearing sleeves 42; and a pair of fastener nuts 44 which fixedly join to the opposite ends of the central shaft 41. When joined together, the shaft assembly 40 is horizontally elongate and cylindrical to define a horizontal pivot axis 46 about which the upright 27 pivots when connected thereto. The bearing sleeves 42 also include radial projections 47 as seen in FIGS. 2 and 4.

The shaft assembly 40 also supports a pair of coil springs 50 which resist rearward tilting of the upright 26. The coils of the springs 50 are supported concentrically on the spring support sleeve 43 as seen in FIG. 4. Each spring 50 includes a rear leg 51 which projects horizontally rearwardly and acts upwardly on the upright 27, and also includes a front leg 52 which projects horizontally forwardly within a front open area of the control body 26.

To adjust the upward biasing force applied by the rear leg 51 on the upright 27, a tension adjustment mechanism 54 is connected between the control body 26 and the front legs 52 which allows the downward deflection of the front legs 52 to be increased or decreased to respectively increase or decrease the springs' biasing force. The tension adjustment mechanism 54 includes a threaded shaft 55 having a lower end rotatably supported on the control body 26 and an upper end projecting upwardly between the front spring legs 52. The threaded shaft 55 is rotatably driven by a knob 56 which is disposed on the bottom of the control body 26 and thus, is accessible by a chair occupant for manual rotation thereof.

The upper end of the shaft 55 includes a U-shaped yoke 57 which seats over or straddles the front spring legs 52 and is connected to the shaft 55 by a nut arrangement 58. By rotating the shaft 55 with the knob 56, the yoke 57 travels axially downwardly and upwardly along the shaft 55 to pull the front spring legs 52 downwardly or allow the spring legs 52 to move upwardly to thereby adjust the biasing force of the rear spring legs 51.

The tilt control 14 includes a lower cover 60 (FIG. 2) which covers a bottom of the control body 26, and includes an upper cover 61 which covers the top of the upright 27.

Turning to the upright 27, the upright 27 is generally L-shaped wherein a front end of a horizontal leg 65 is pivotally supported on the control body 26, and an upper end of a vertical leg 66 supports the back assembly 16 thereon. The horizontal leg 65 is formed of stamped metal and has side walls 67 which each include a connector hole 68 near the front end thereof.

The connector holes 68 are aligned with each other and are generally D-shaped, which shape corresponds to the shape of the bearing sleeves 42 as defined by the radial projections 47. The holes 68 are supported on the bearing sleeves 42 so that the upright 27 is pivotally connected to the control body 26 and is able to pivot about the pivot axis 46. During rearward tilting of the back assembly 14, the upright 27 moves to the position illustrated in phantom outline in FIG. 6, and during forward tilting, the upright 27 moves to the position of FIG. 7A.

A top wall 69 of the horizontal leg 65 joins the side walls 67 together, wherein the rear spring legs 51 press upwardly, i.e. generate a biasing force, on the opposing bottom surface of the top wall 69. While the springs 50 tend to bias the upright 27 upwardly in the forward tilt direction, the spring legs 51 also are deflectable downwardly in response to rearward tilting of the upright 27 about the tilt axis 46.

The top wall 69 further includes fastener holes 69*a* near the back end thereof. The vertical leg 66 of the upright 27 is generally L-shaped and has a front end thereof rigidly connected to the fastener holes 69*a* (FIG. 2) by fasteners 66*a* (FIG. 3).

The upright 27 also is adapted to support a tilt lock mechanism 70 which is provided to permit selective locking out of forward and rearward tilting. In this regard, the side walls 67 include front holes 71 and rear holes 72, the function of which will be described in further detail relative to the lock mechanism 70.

Also, the horizontal leg 65 of the upright 27 includes a pair of sidewardly spaced apart slots 73 which open vertically through the top wall 69. The slots 73 are sidewardly elongate and are located near the front holes 71.

Generally as to the tilt lock mechanism 70, the tilt lock mechanism 70 includes a rear tilt lock plate 75, a front tilt lock lever 76 and an actuator arrangement 77 for selectively actuating the rear tilt lock plate 75 and the front tilt lock lever 76.

The rear tilt lock plate 75 hangs downwardly from the slots 73 in the upright 27 as seen in FIG. 4, wherein the rear tilt lock plate 75 is swingable forwardly into engagement with the stop flange 34 of the control body 26 (FIG. 4) to prevent rearward tilting, and rearwardly away from the stop flange 34 (FIG. 5) to permit rearward tilting.

The front tilt lock lever 76 is pivotally connected to the front holes 71 of the upright side walls 67 and thus, is swingable forwardly into engagement with the stop flange 34 (FIG. 5) to prevent forward tilting, and rearwardly away from the stop flange 34 (FIG. 6) to permit rearward tilting.

To control this locking and unlocking of forward and rearward tilting, the actuator arrangement 77 includes a handle assembly 78 which is rotatably connected to the rear holes 72. The handle assembly 78 is operatively connected to the rear tilt lock plate 75 and the front tilt lock lever 76 to control movement thereof as described in further detail hereinafter.

Turning to the handle assembly 78, the handle assembly 78 includes the actuator handle 17 which is manually rotatable through three operative positions as seen in FIG. 1, namely first, second and third operative positions P1, P2 and P3. The handle 17 is illustrated in solid outline in the second or intermediate handle position 80 wherein forward tilting from the normal upright or nominal position of the upright 27 is locked out and rearward tilting is permitted.

When the handle 17 is rotated upwardly to the first operative position P1, which is diagrammatically illustrated in FIG. 1 as a dotted line, then both forward and rearward tilting is locked out from the nominal position or even from forwardly and rearwardly tilted positions. When the handle 17 is rotated downwardly through the second operative position P2 to the third operative position P3, then forward and rearward tilting is permitted.

Figure 8:
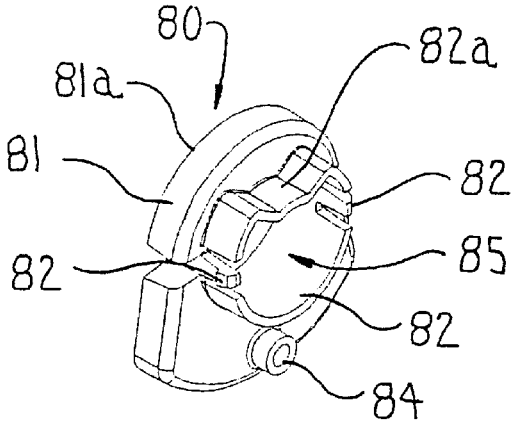
FIG. 8 is a rear perspective view of a detent insert that cooperates with an actuator handle to define the first through third operative positions.
Figure 9:
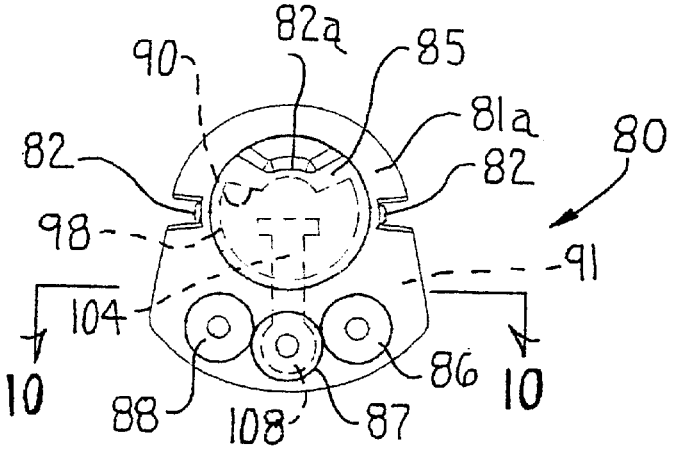
FIG. 9 is an end view of the insert with the actuator handle diagrammatically illustrated in phantom outline.

More particularly as to the components of the tilt lock mechanism 70, the first to third operative positions are defined by a detent arrangement which includes a plastic detent insert 80 which is illustrated in FIGS. 8–9. The detent insert 80 includes an insert body 81 having a partially circular flange 82 that snap fits into the rear hole 72 on the left side wall 67 of the upright 27. As seen in FIG. 2, the insert 80 is located on the inside face of the left side wall 67. The insert 80 is held in place by resilient fingers 83 formed in the flange 82 which grip the wall material of wall 67.

The flange 82 defines a bore 85 which opens horizontally therethrough to define a shaft bearing. The bore 85 has a semi-circular shape due to a projection 82*a* which projects radially inwardly.

A stop post 84 also projects outwardly from the insert body 81 below the flange 82. The post 84 fits sidewardly into a corresponding hole formed in the left side wall 67 and prevents rotation of the insert 80 in the left rear hole 72.

To define the three operative positions of the handle 17, the inside face 81*a* of the insert body 81 includes three dimples or recesses 86, 87 and 88 which are angularly spaced apart. The three dimples 86–88 cooperate with the handle 17 and define positive stops for positions P1, P2 and P3 respectively.

More particularly, handle 17 has a two-part construction as seen in FIG. 2, which includes a fixed but rotatable outer handle part 90 and an axially-movable inner handle part 91 which rotates with the outer handle part 90.

Figure 11:
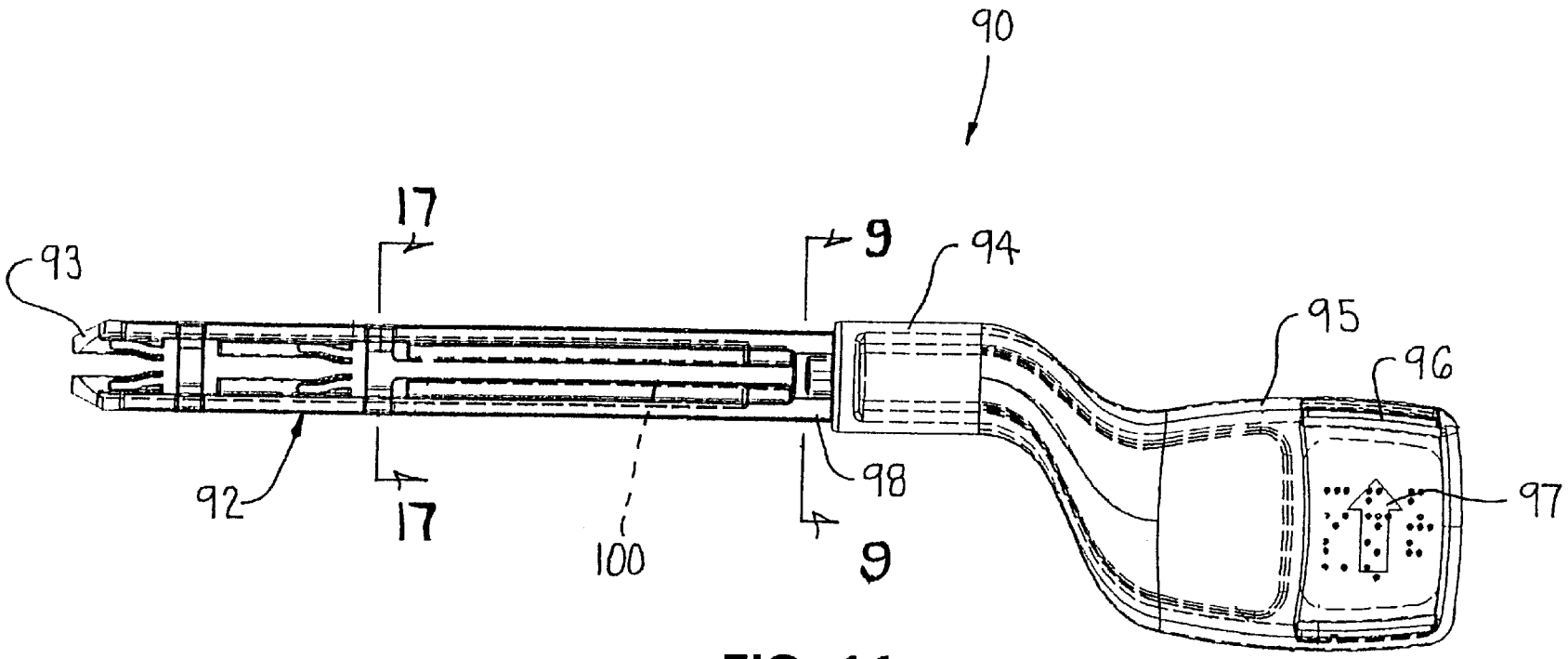
FIG. 11 is a plan view of an outer handle section of the handle.

The outer handle part 90 (FIG. 11) includes an elongate shaft section 92 having an inner end 93 and an outer end 94. Outer shaft end 94 includes an enlarged handpiece 95 which is disposed outwardly of the left side wall 67 when the outer handle part 90 is connected to the upright 27. As such, the chair occupant can manually rotate the handle 17.

The handpiece 95 is offset forwardly and upwardly relative to the axis of the outer shaft section 92, which increases the rotational torque on the outer handle part 90 when the handpiece 95 is rotated manually by the occupant. The handpiece 95 includes a label 96 on an upper surface thereof containing an arrow 97 to provide guidance to the occupant.

When the outer handle part 90 is rotatably supported in the detent insert 80, an intermediate shaft section 98 is rotatably supported within the bore 85 of the insert 80. The intermediate shaft section 98 is illustrated in phantom outline in FIG. 9. The intermediate shaft section 98 has a non-circular cross section which limits rotational movement of the outer handle part 90 to a rotational path extending angularly through the first to third operative positions P1 to P2.

Figure 17:
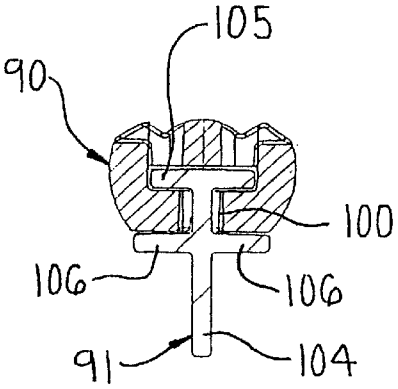
FIG. 17 is a side cross-sectional view of the inner and outer handle sections mated together.

Along the inner end 93 of the outer handle part 90, a horizontally elongate T-shaped groove 100 is defined therein which opens sidewardly from the inner end 93 to receive the inner handle part 91 axially therein. Referring to FIG. 17, the cross-sectional shape of the outer handle part 90 is illustrated along with the T-shaped groove 100.

The second part of the handle assembly 78 is the inner handle part 91 which is illustrated in FIGS. 13–17. One end of the inner handle part 91 includes a rotation support pin 102 which is rotatably received within the right right side rear hole 72 defined in the right side wall 67 of the upright 27. Inner handle part 91 also includes a horizontally elongate shaft body 103 which is defined by a vertical web 104, a top plate 105 and lower ribs 106 which project sidewardly from the center web 104. The top edge of the shaft body 103, as defined by an upper portion of the vertical web 104 and the horizontal top plate 105, defines a T-shaped section which is slidable axially into the corresponding T-shaped groove 100 of the outer handle part 90. The outer and inner handle parts 90 and 91 thereby are slidably joined together as seen in the cross-sectional view of FIG. 17 and the assembly view of FIG. 3. When the outer and inner handle parts 90 and 91 are slidably fitted together, the handle assembly 78 is formed wherein the handle assembly 78 is rotatably supported on the upright 27. In particular, the handle assembly 78 is rotatably supported at one end by the pin 102 which is received within the respective rear hole 72, and is supported at the opposite end by the intermediate shaft section 98 of the outer handle part 90 that is rotatably supported within the insert 80 so that the handle assembly 78 is rotatable about a rotation axis 107 (FIG. 3).

Figure 10:
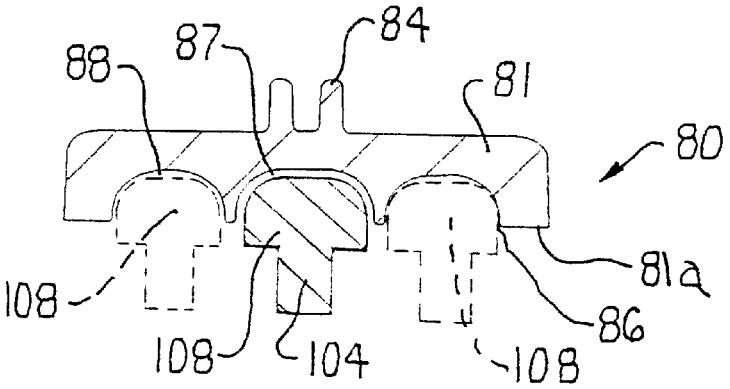
FIG. 10 is a cross-sectional plan view of the insert and handle as taken along line 10—10 of FIG. 9.

The end of the shaft body 103 further includes a sphere-like detent 108 which is adapted to be received within the recesses 86-88 of the insert 80. Referring to FIGS. 9 and 10, the detent 108 is received axially into the open side of any one of the recesses 86, 87 or 88. To permit rotation of the handle assembly 78 which causes the detent 108 to move to another of the recesses 86, 87 or 88, the inner handle part 91 is axially movable as indicated by reference arrow 110 in FIG. 3. A spring 111 is provided in compression between an inner face of the upright side wall 67 and a shoulder 112 formed on the shaft body 103. Thus, the spring 111 biases the inner handle part 91 axially toward the other side of the upright 27 which thus causes the detent 108 to be biased axially into one of the recesses 86-88. During rotation of the handle assembly, however, the inner handle part 91 is displaceable axially away from the insert 80 to allow the detent 108 to be displaced angularly into another of the recesses 86, 87 or 88. Thus, the rotation of the handpiece 95 causes the handle assembly 78 to snap into one of the three operative positions, P1, P2 or P3.

To control the rear tilt lock plate 75 during rotation of the handle assembly 78, the vertical web 104 of the shaft body 103 includes a rigid actuator arm 115 which projects radially forwardly and terminates at a distal front end 116. The vertical web 104 further includes a spring connector hole 117 which is spaced axially from the actuator arm 115 and is disposed proximate the detent 108.

Figure 14:
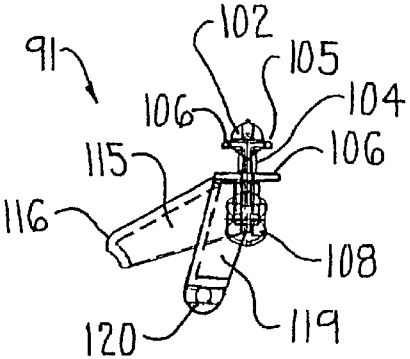
FIG. 14 is a right side end view of the inner handle section.
Figure 16:
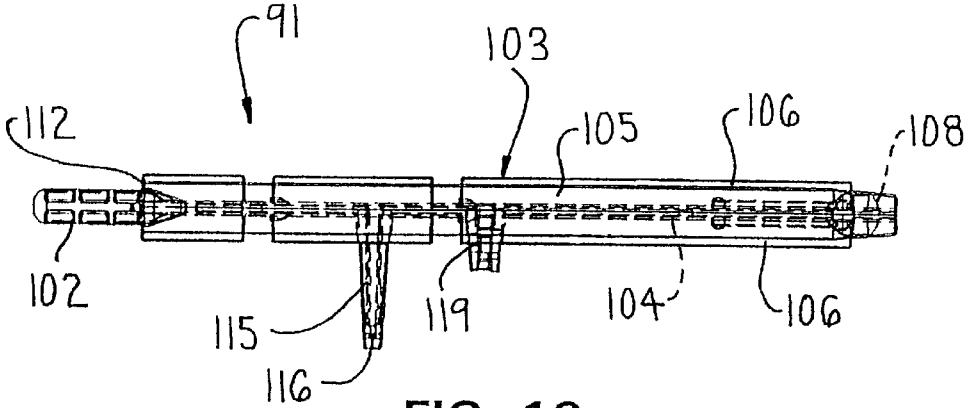
FIG. 16 is a plan view of the inner handle section.
Figure 15:
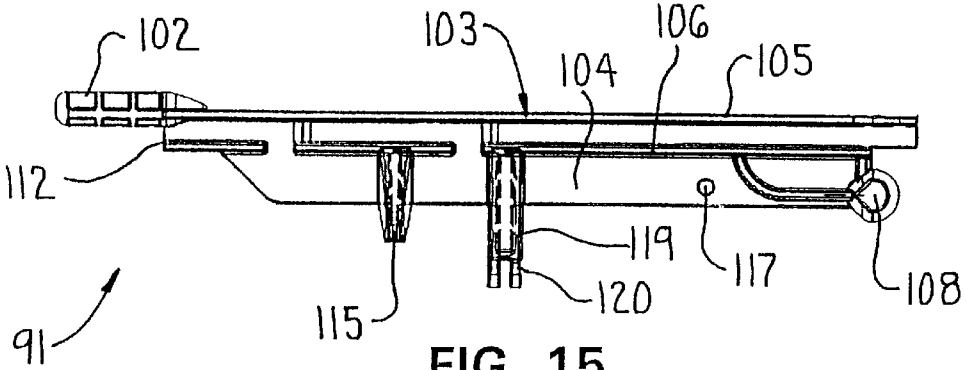
FIG. 15 is a front elevational view of the inner handle section.

To control the front tilt lock lever 76 during rotation of the handle assembly 78, the vertical web 104 further includes a spring wire connector arm 119 which projects radially from the web 104. The distal end of the connector arm 119 is forked and defines a spring wire connector hole 120 which opens sidewardly therethrough. The actuator arm 115 and the connector arm 119 are angularly spaced apart such that the actuator arm 115 projects forwardly a greater distance but is located higher than the connector arm 119 as can be seen in FIG. 14.

Figure 5:
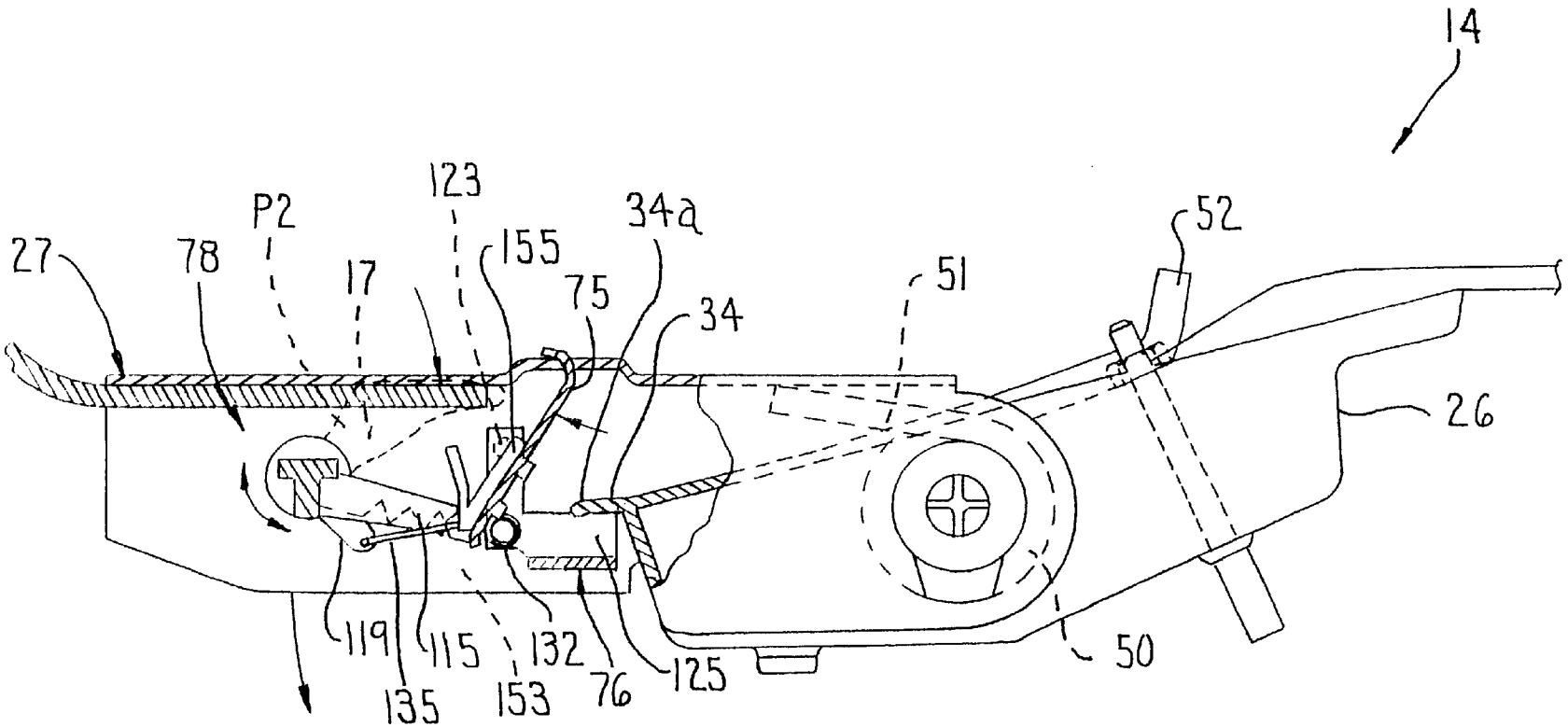
FIG. 5 is a right side elevational view in partial cross section illustrating the actuator in a second operative position.
Figure 19:
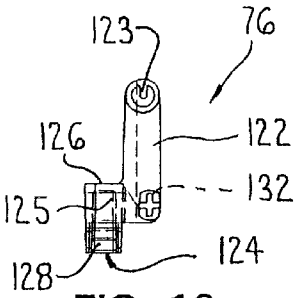
FIG. 19 is a right side end view of the front tilt lock lever.
Figure 20:
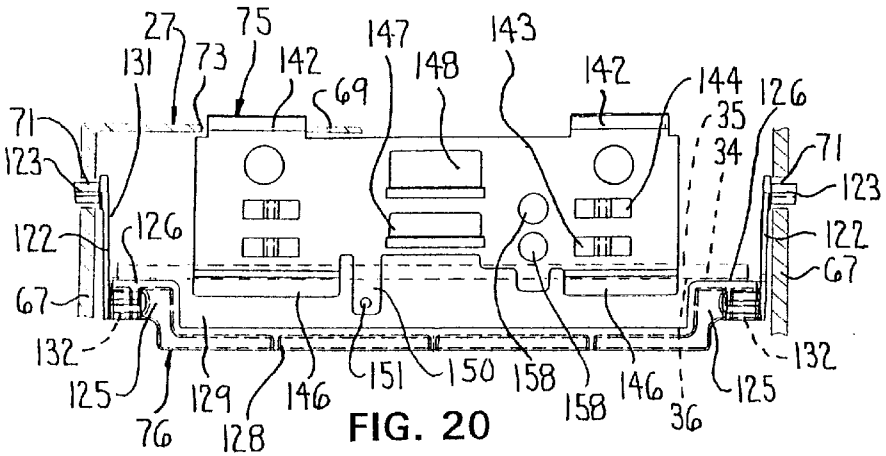
FIG. 20 is a front view of the front tilt lock lever and a rear tilt lock plate.
Figure 18:
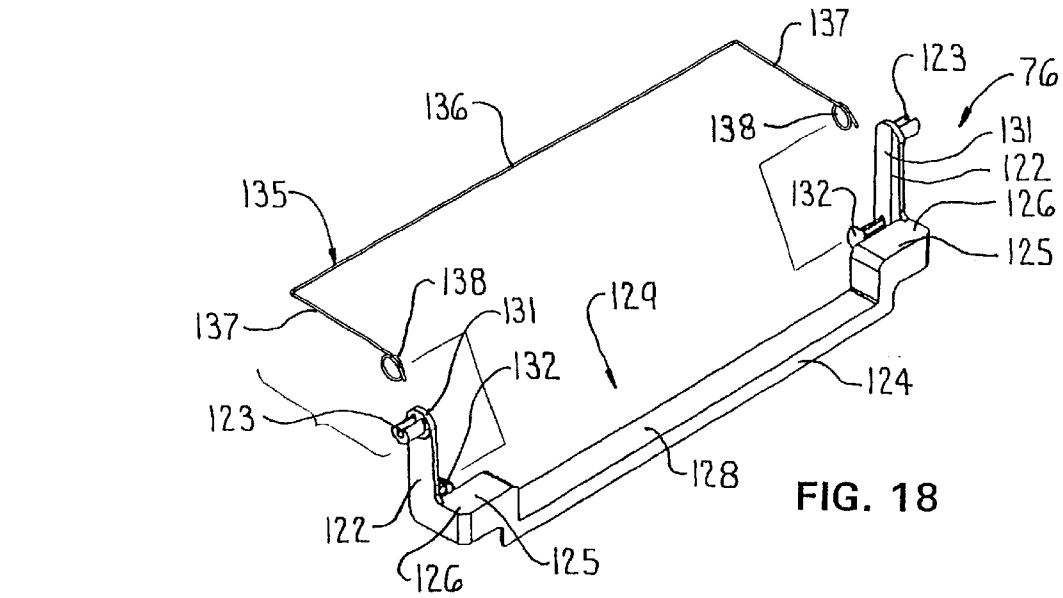
FIG. 18 is a perspective view of a pivotable front tilt lock lever and a spring wire which connects thereto.

Referring to the part drawings of FIGS. 18–20 and the assembly drawing of FIG. 3, the front tilt lock lever 76 is pivotally connected to the front hole 71 in the side wall 67 of the upright 27. The front tilt lock lever 76 is adapted to catch on the stop flange 34 defined on the control body 26 to prevent vertical pivoting of the upright 27 as generally illustrated in FIGS. 4 and 5.

More particularly as to the front tilt lock lever 76, the lever 76 includes vertical arms 122 having pivot pins 123 near the upper end thereof that are pivotally inserted into the respective front hole 71. As such, the lever 76 is suspended downwardly from the pivot pins 123.

The support arms 122 are joined sidewardly by a cross bar 124. The cross bar 124 is connected to the front edges of the support arms 122 so as to be offset forwardly of the pivot pins 123 as illustrated in FIG. 19.

The cross bar 124 includes stop blocks 125 at the opposite ends thereof directly adjacent to the support arms 122 which stop blocks 125 define upward facing stop surfaces 126. When the lever 76 is pivoted to the engagement position of FIGS. 3 and 4, the stop blocks 125 hook underneath the stop flange 34 on the control body 26 to prevent pivoting of the upright 27 in the forward tilt direction. Specifically, the stop surfaces 126 abut against the downward facing lower surface 36 of the stop flange 34 as seen in FIG. 20.

The cross bar 124 also includes a stepped section 128 which is spaced downwardly of the stop blocks 125 to define a clearance space 129 to thereby avoid interference with the rear tilt lock plate 75 (FIG. 20).

To connect the front tilt lock lever 76 to the handle assembly 78, the inside faces 131 of the support arms 122 include spring wire connector pins 132 rearwardly adjacent of the stop blocks 125. A spring wire 135 is directly connected between the connector pins 132 on the lever 76 and with the connector arm 119 on the shaft assembly 76.

In particular, the spring wire 135 is U-shaped so as to define a transverse section 136, forward arms 137 and coils 138 on the front ends thereof. The coils snap onto the respective spring wire connector pins 132 on the lever 76 while the transverse wire section 136 is fixed to and extends sidewardly through the opening 120 of the spring wire connector arm 119. As a result, the lever 76 is connected to the handle assembly 76 by the intermediate spring wire 135.

As a result, rotation of the handle 17 to the first operative position P1 (FIG. 4) swings the support arm 119 forwardly which causes the spring wire 135 to resiliently push the front tilt lock lever 76 into engagement with the stop flange 34. However, when the handle 17 is rotated to the third operative position P3 (FIG. 6), the spring wire 135 pulls the front tilt lock lever 76 rearwardly to disengage the stop blocks 125 rearwardly away from the stop flange 34. As the handle 17 is rotated in the opposite direction to the first operative position P1, the spring wire 35 again pushes the front tilt lock lever 76 forwardly until the stop blocks 125 are disposed below the stop flange 34 to again prevent forward tilting.

Figure 22:
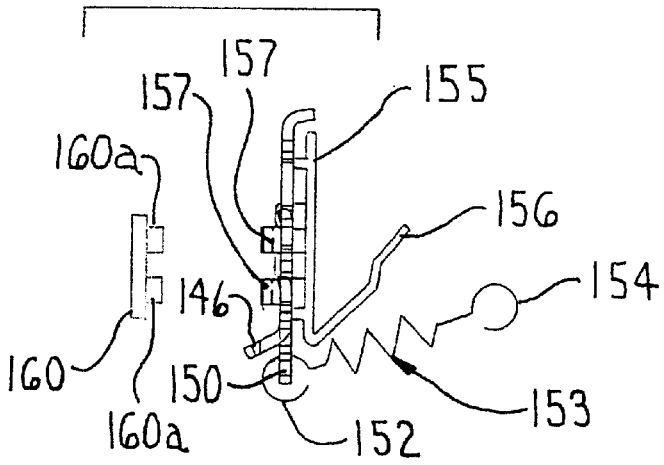
FIG. 22 is a right side view of the rear tilt lock assembly.
Figure 21:
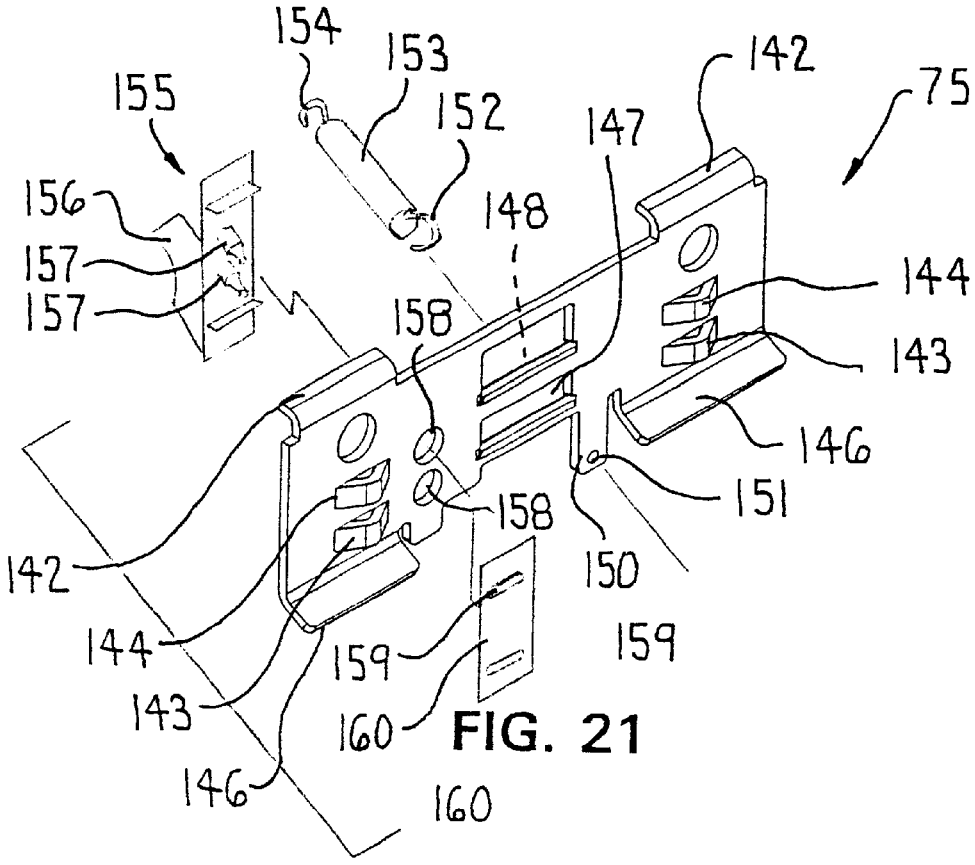
FIG. 21 is an exploded perspective view of a rear tilt lock assembly which includes the rear tilt lock plate in combination with a silencer unit and the coil spring of FIG. 12.

With respect to the lock-out arrangement for locking out rearward tilting, the rearward tilt lock plate 75 is provided which component is illustrated in the part drawings of FIGS. 20–22 and the assembly drawing of FIG. 4. The rearward tilt lock plate 75 is formed as a vertically enlarged plate having a pair of curved tabs 142 which project rearwardly from the upper edge thereof and hook into the slots 73 formed in the top wall 69 of the upright 27. The tabs 142 define a pivot connection which allows the rear tilt lock plate 75 to swing forwardly and rearwardly between the engaged position of FIG. 4 wherein rearward tilting is prevented and the disengaged position of FIGS. 5 and 6 wherein rearward tilting is permitted.

More particularly, the tilt lock plate 75 includes a lower pair of projections 143 and an upper pair of projections 144. When the rear tilt lock plate 75 is engaged with the stop flange 34, the lower projections 143 overlie and abut against the upper surface 35 of the stop flange 34 to thereby prevent rearward tilting of the upright 27. When the tilt lock plate 75 is swung rearwardly to the disengaged position of FIG. 5, the upright 27 can pivot rearwardly to the rearwardly tilted position illustrated in phantom outline in FIG. 27.

The rear tilt lock plate 76 further includes forwardly projecting stop flanges 146 on the bottom edge thereof and a lower stop window 147 and an upper stop window 148 which are defined sidewardly between the pairs of projections 143 and 144.

Figures 12, 13:
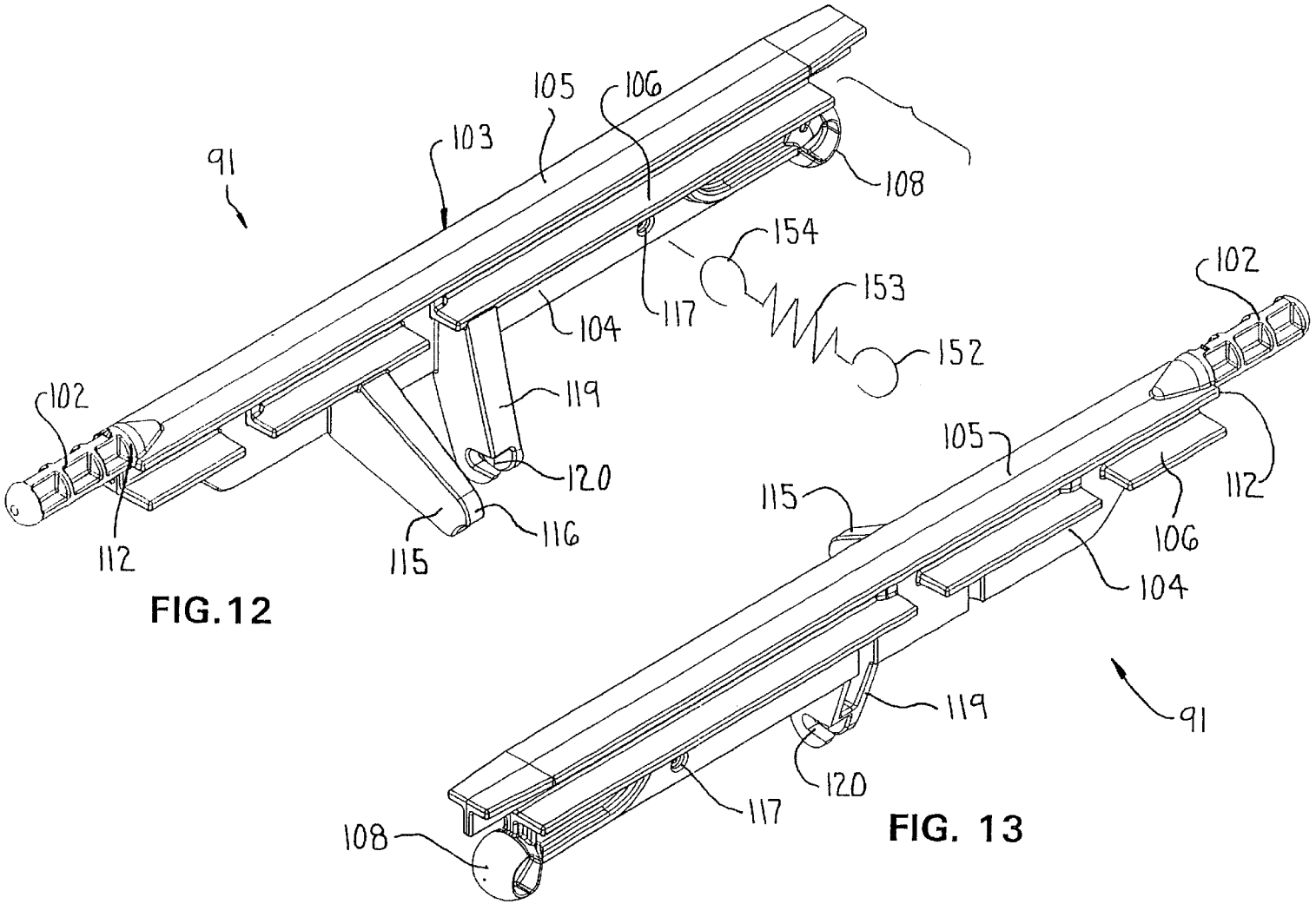
FIG. 12 is a front perspective view of an inner handle section diagrammatically illustrating a coil spring which connects thereto.
FIG. 13 is a rear perspective view of the inner handle section.

Further, a downwardly extending connector flange 150 is provided having a coil spring connector hole 151. The connector hole 151 receives the hooked end 152 of a coil spring 153. The coil spring 153 also includes a rear hook 154 which hooks into the corresponding connector hole 117 of the handle assembly 78 as illustrated in FIGS. 3, 12 and 22. The coil spring 153 serves to resiliently pull the lock plate 75 out of engagement with the stop flange 34 in response to rotation of the handle assembly 78 to the second operative position P2.

To swing the rear tilt lock plate 75 forwardly, the tilt lock assembly of FIGS. 21 and 22 includes a generally V-shaped spacer having a resilient leg 156 which is adapted to abut against the actuator arm 115 of the handle assembly 78. To connect the spacer 155 to the lock plate 75, the spacer plate includes posts 157 which are adapted to project forwardly through holes 158 formed in the lock plate 75. The posts 157 define snap fit connectors which engage oval openings 159 formed in a silencer plate 160. The ends of the posts 157 insert into cylindrical walls 160a and snap through the oval openings 159 so that the lock plate 75 is sandwiched between the spacer part 155 and the silencer 160. The silencer 160 is adapted to abut against the metal stop flange 34 to eliminate noise created thereby. As for the resilient leg 156, this leg 156 contacts the actuator arm 115 of the handle assembly which pushes the rear tilt lock plate 75 towards the stop flange 34 upon rotation of the handle 17 to the first operative position P1.

In operation, the front tilt lock lever 76 and the rear tilt lock plate 75 cooperate with the stop flange 34 and the tab 34*a* projecting therefrom to selectively control forward and rearward tilting and maintain the chair in any one of a plurality of forwardly tilted or rearwardly tilted positions.

Starting with FIG. 4, the handle 17 is illustrated in the first operative position which causes the actuator arm 115 to be pivoted forwardly to push the resilient spacer leg 156 which swings the rear tilt lock plate 75 forwardly into engagement with the stop flange 34. When the upright 27 is in the nominal or normal upright position of FIG. 4, the lower projections 143 on the lock plate 75 lie on top of the stop flange 34 and prevent rearward tilting.

Additionally, when in the first operative position, the connector arm 119 is swung forwardly which pushes the spring wire 135 forwardly to resiliently bias the front tilt lock lever 76 also into engagement with the stop flange 34. In this engaged position, the stop blocks 125 are disposed below the stop flange 34 and prevent forward tilting of the chair. As the handle 17 is moved to the first operative position Pi, the resilient connections defined by the spring wire 135 and the resilient leg 156 permit the handle 17 to be moved to the first operative position even if the tilt lock plate 75 and the front tilt lock plate 76 are not able to move to the engaged position due to misalignment of these parts with the stop flange 34. The spring wire 135 and the resilient leg 156 continue to bias these components forwardly and eventually, due to chair movement, these parts will align with the stop flange 34 and snap to the engaged position of FIG. 4. In this condition, forward and rearward tilting from the nominal position is locked out.

If the handle 17 is moved to the second operative position, P2, the connector arm 119 and the actuator arm 115 rotate away from the stop flange 34. As a result, the handle assembly 78 pulls the rear tilt lock plate 75 rearwardly out of engagement due to the spring 153 which is connected between the handle assembly 78 and the rear tilt lock plate 75. If the rear tilt lock plate 75 binds on the stop flange 34 and is not able to disengage therefrom, the handle 17 can still move to the second operative position P2 due to the resiliency of the spring 153 and once the occupant shifts and allows the tilt lock plate 75 to disengage from the stop flange 34, the coil spring 153 pulls the plate 75 to the disengaged position of FIG. 5 such that rearward tilting from the nominal position is permitted while forward tilting remains locked out.

Figure 6:
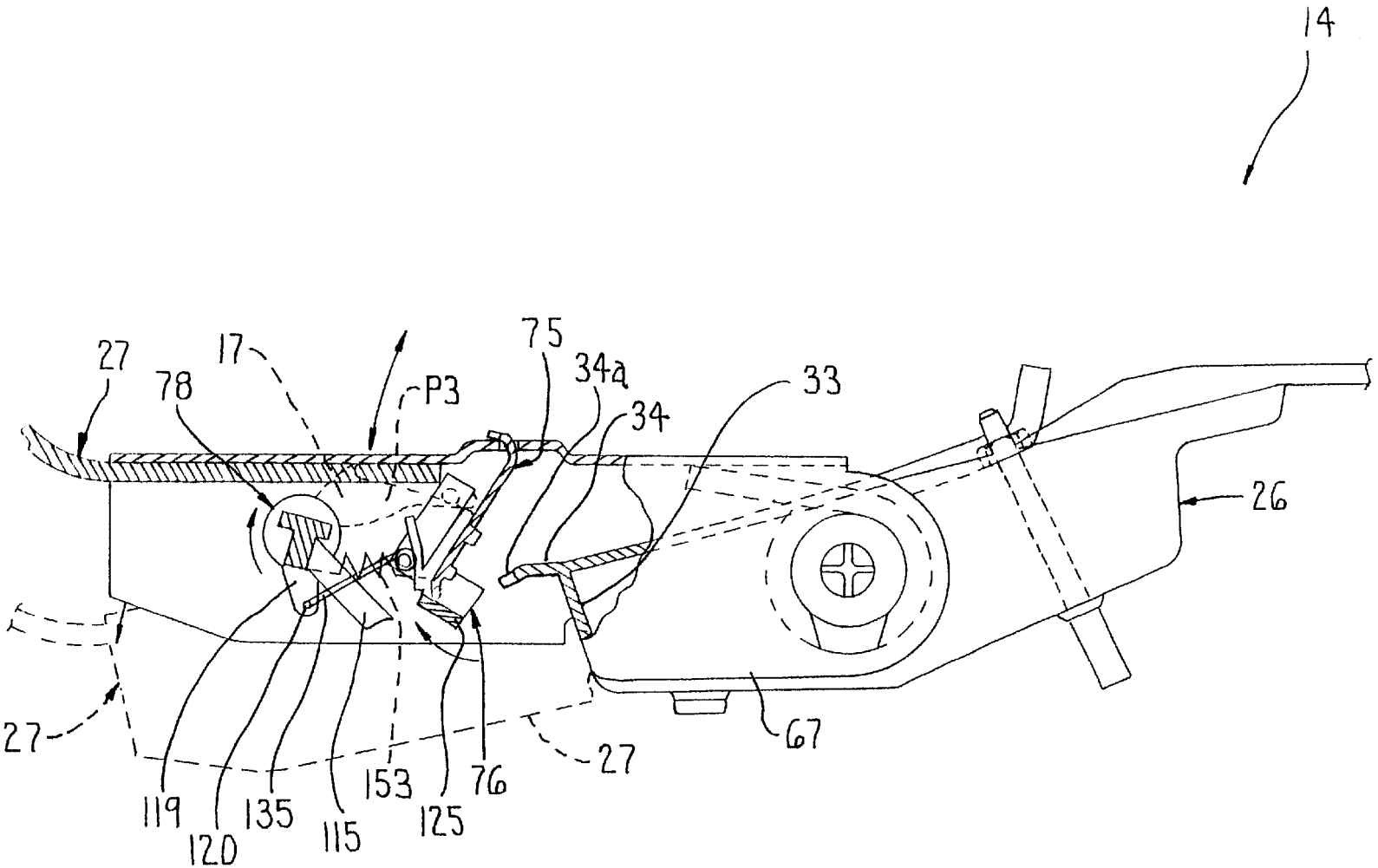
FIG. 6 is a right side elevational view in partial cross section illustrating the actuator in a third operative position.

Referring to FIG. 6, the handle 17 can also be rotated to the third operative position P3 whereby the spring wire 135 pulls the front tilt lock lever 76 out of engagement with the stop flange 34. Again, if the front tilt lock lever 76 hangs on the stop flange 34, the handle 17 can move to the third operative position until such time as the front tilt lock lever 76 is freed and the spring wire 135 pulls this component to the disengaged position. When in the third operative position, the upright 27 is freely movable in the forward and rearward tilt directions.

Figure 7A:
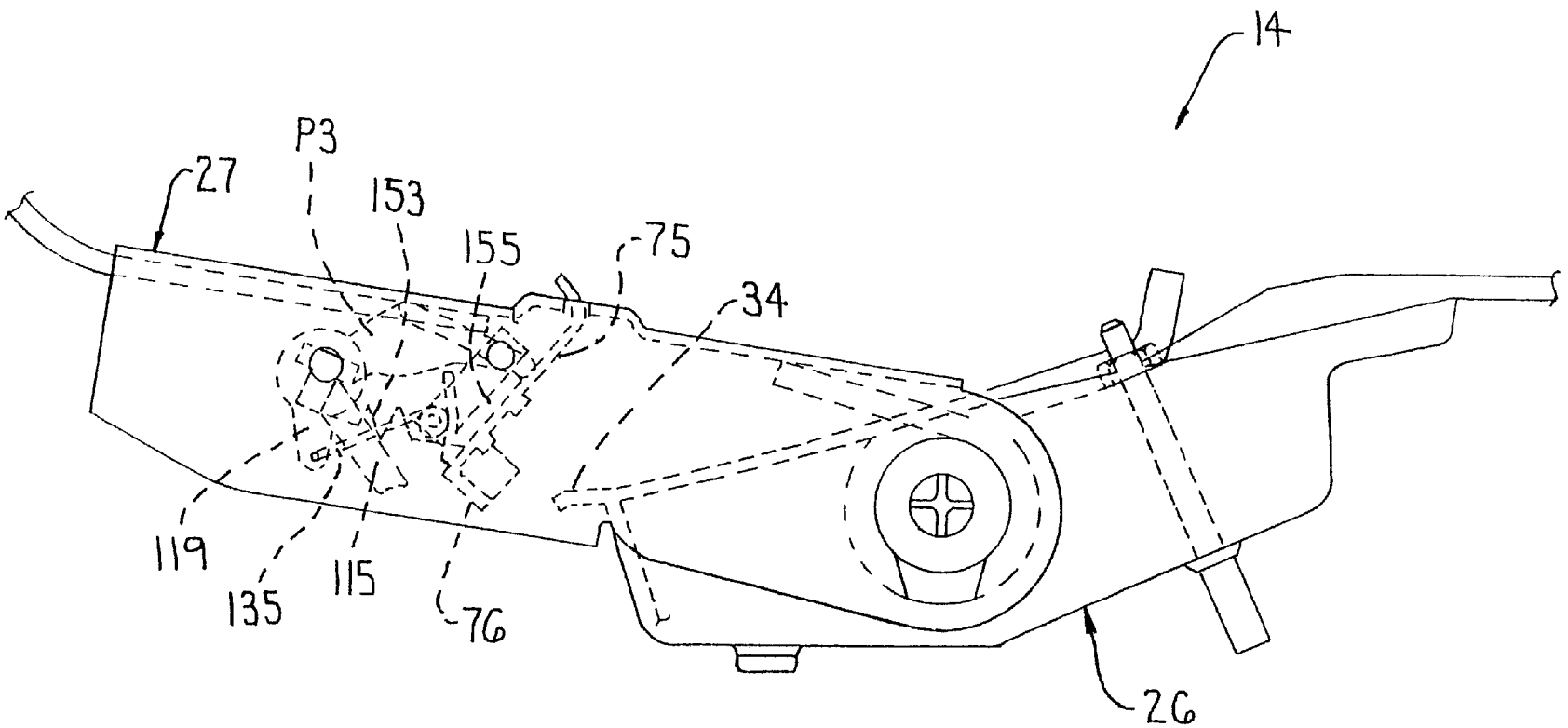
FIG. 7A is a right side elevational view illustrating the actuator in the third operative position with the upright for the back assembly in a forwardly tilted position.
Figure 7B:
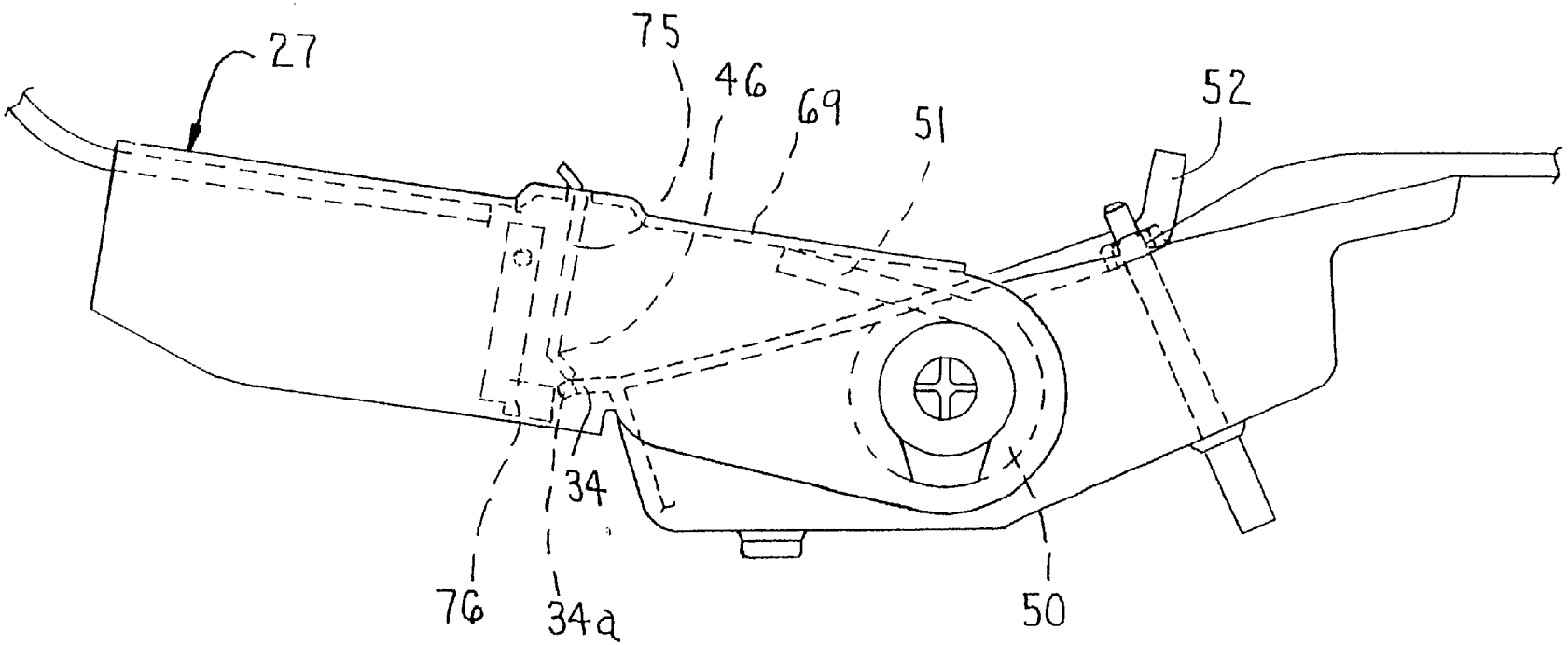
FIG. 7B is a right side elevational view illustrating the upright locked in the forwardly tilted position when the actuator is in the first operative position.

Referring to FIGS. 7A and 7B, when forward tilting occurs, the upright 27 pivots relative to the control body 26. If it is desired that the upright 27 be locked in this forwardly tilted position, the actuator handle 17 is rotated to the first operative position P1 which causes the rear tilt lock plate 75 to swing into the vertical space defined between the top wall of the upright 27 and the top of the stop flange 34. The stop flanges 146 on the lock plate 75 lie directly on the upper surface of the stop flange 34 to thereby prevent rearward tilting of the upright 27. Since this is the forward limit of movement, forward tilting also cannot occur. In this condition, the front tilt lock lever 76 is biased forwardly by the spring wire 135 but abuts against the back edge of the stop flange 34 and further movement is prevented. However, the handle 17 can still move to the first operative position (FIG. 4) since the spring wire 135 is able to resiliently deflect.

Figure 23:
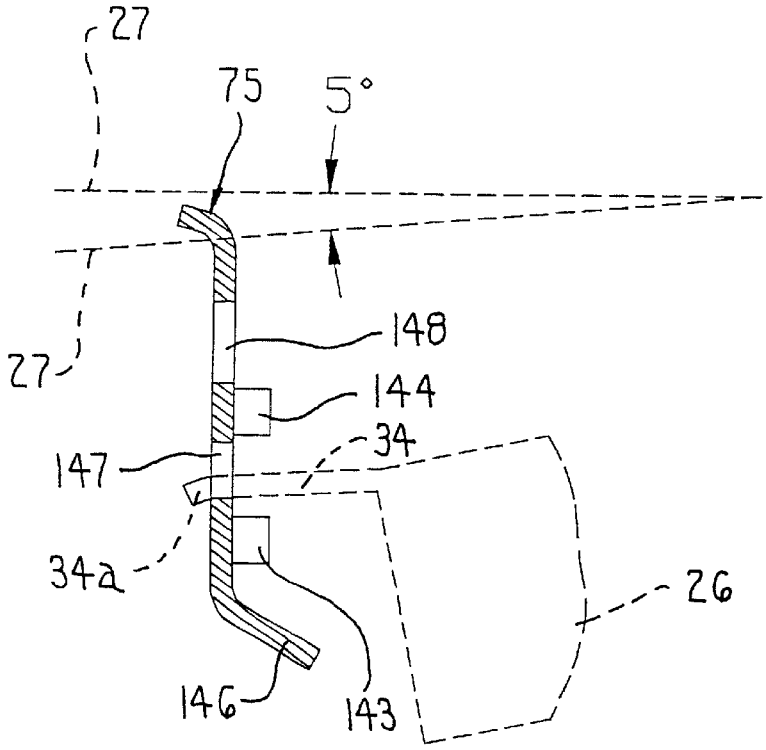
FIG. 23 is a diagrammatic side view of the rear tilt lock handle engaged with the stop flange when the chair is rearwardly tilted 5° from the nominal position of FIG. 4.

Alternately, it also is possible to lock the upright 27 in one of two rearwardly tilted positions that are tilted 5° and 10° respectively from the nominal position illustrated in FIG. 4. In particular, as diagrammatically illustrated in FIG. 23, the tilt lock plate 75 is still able to pivot forwardly to the engaged position with the stop flange 34 when the handle 17 is in the first operative position P1 and the chair is tilted. However, rather than having the lower projections 43 abut against the stop flange 34, rearward tilting movement is prevented by the upper projections 144 which abut against the top surface 35 of the stop flange 34. In this position, the tab 34a of the stop flange 34 also projects rearwardly through the lower window 147 and hooks onto a lower edge of the opening window 147. The tab 34*a* thereby prevents forward tilting of the chair.

Figure 24:
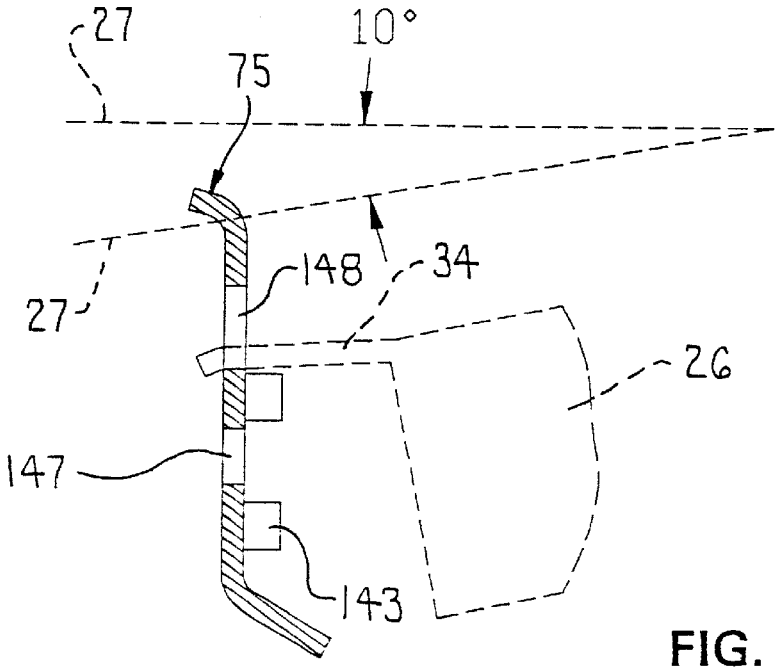
FIG. 24 is a diagrammatic side view of the rear tilt lock handle engaged with the stop flange when the chair is rearwardly tilted 10° from the nominal position of FIG. 4.

Referring to FIG. 24, the upright 27 also can be pivoted and locked in the rearwardly tilted position that is spaced 10° from the nominal position. When in the 10° rearwardly tilted position, the tab 34*a* inserts rearwardly through the upper window 148 of the rear tilt lock plate 75. Hooking of the tab 34*a* on the lower edge of the opening 148 thereby prevents forward tilting of the chair. Forward tilting can again be permitted by pivoting the handle 17 at least to the second operative position P2 which pulls the rear tilt lock plate 75 rearwardly away from the stop flange 34. As can be seen with the above-described arrangement, a single actuator serves to operate both forward and rearward tilting and also maintain the upright 27 in a variety of tilted positions.

Although a particular embodiment of the invention has been disclosed in detail for illustrative purposes, it will be recognized that variations or modifications of the disclosed apparatus, including the rearrangement of parts, lie within the scope of the present invention.

What is claimed is:

1. An office chair comprising:

a seat assembly;

a back assembly which projects upwardly from a rear edge of said seat assembly; and a tilt control which connects said seat assembly and said back assembly together, said tilt control including a control body which supports said seat assembly and an upright which is pivotally connected to said control body and supports said back assembly, said upright being pivotable about a sidewardly-extending horizontal pivot axis so as to be pivotable forwardly from a normal upright position to a forwardly tilted position and rearwardly to a rearwardly tilted position, said tilt control including a lock mechanism which cooperates with said upright and said control body to selectively lockout or permit forward and rearward tilting, said lock mechanism including an actuator which is movable along an elongate path through first, second and third operative positions wherein both forward and rearward tilting is locked out when the actuator is one of the first to third operative positions, only one of forward and rearward tilting is locked out when the actuator is in another of the first to third operative positions and both forward and rearward tilting is permitted when the actuator is in still another of the first to third operative positions.

2. The chair according to claim 1, wherein the actuator is movable back and forth through the first, second and third operative positions to selectively control forward and/or rearward tilting.

3. The chair according to claim 2, wherein said actuator locks out both forward and rearward tilting when in said first operative position, locks out only forward tilting when in said second operative position while permitting rearward tilting, and permits both forward and rearward tilting when in said third operative position.

4. The chair according to claim 3, wherein said actuator is rotatable and moves through three rotary positions which define said first, second and third operative positions.

5. The chair according to claim 1, wherein said tilt control includes first and second lockout members which are movably supported on said upright, said first and second lockout members being movable into and out of engagement with said control body in response to movement of said actuator through said first, second and third operative positions, said first and second lockout members respectively preventing forward and rearward tilting when engaged with said control body.

6. The chair according to claim 5, wherein biasing members are provided to interconnect each of said first and second lockout members to said actuator.

7. The chair according to claim 6, wherein said control body includes a fixed stop portion which is engagable with said first and second lockout members when in a alignment therewith to lockout forward and/or rearward tilting, said biasing members biasing said first and second lockout members into engagement with said stop portion when in alignment and providing a biasing force biasing said first and second lockout members towards said stop portion when misaligned which permits said actuator to be moved to a next one of s aid operative positions even though said first and second lockout members remain disengaged from said stop portion due to said misalignment.

8. The chair according to claim 1, wherein a resilient biasing member is connected between said control body and said upright to normally bias said upright in the forward tilt direction toward said upright position while permitting relative pivoting movement between said control body and said upright during forward and rearward tilting.

* * * * *